US005678115A

United States Patent [19]

Pagano

[11] Patent Number: 5,678,115

[45] Date of Patent: Oct. 14, 1997

[54] METHOD AND APPARATUS FOR PROCESSING A PHOTOSENSITIVE MATERIAL

[75] Inventor: Daniel Michael Pagano, Henrietta, N.Y.

[73] Assignee: Eastman Kodak Company, Rochester, N.Y.

[21] Appl. No.: 648,604

[22] Filed: May 15, 1996

[51] Int. Cl.[6] ..... G03D 3/04

[52] U.S. Cl. ..... 396/595; 396/620; 396/633

[58] Field of Search ..... 396/595, 597, 396/599, 600, 633, 626, 630; 366/137

[56] References Cited

U.S. PATENT DOCUMENTS

| | | | |
|---|---|---|---|
| 4,011,573 | 3/1977 | Braico | 396/622 |
| 4,015,615 | 4/1977 | Weber et al. | 134/196 |
| 4,362,377 | 12/1982 | Yoshida et al. | 396/633 |
| 4,579,437 | 4/1986 | Linderfelt | 396/633 |
| 4,834,306 | 5/1989 | Robertson et al. | 354/275 |
| 5,023,644 | 6/1991 | Kurematsu et al. | 396/633 |
| 5,093,686 | 3/1992 | Shigaki | 355/77 |
| 5,543,882 | 8/1996 | Pagano et al. | 396/595 |

*Primary Examiner*—D. Rutledge
*Attorney, Agent, or Firm*—Frank Pincelli

[57] ABSTRACT

A method and apparatus for processing an undeveloped filmstrip contained in a reel. The apparatus comprises at least one processing tank containing a processing solution therein. A holding mechanism is provided for holding and retaining the processing reel and for positioning the processing reel within the at least one processing tank so that the filmstrip can be submerged within the processing solution contained in the at least one processing tank. An agitation mechanism is provided and comprises a motor and a propeller connected to the motor. The propeller is disposed within the tank for agitating the processed solution contained in the tank. The motor is activated as the reel is being lowered into the processing solution causes the processing solution to be moved past the filmstrip as it is being placed within the processing solution.

8 Claims, 4 Drawing Sheets

METHOD AND APPARATUS FOR PROCESSING A PHOTOSENSITIVE MATERIAL

FIELD OF THE INVENTION

The present invention relates to the processing of a photosensitive material, and more particularly, to an apparatus for processing photosensitive film spirally placed in a developing reel.

BACKGROUND OF THE INVENTION

Traditional methods for processing photosensitive film contained in cartridges typically involves the separation of the filmstrip from the cartridge prior to processing. In one method, the photographic film is cut away from the cartridge and taped to a leader board, or a length of flexible film, after which the film is drawn through a series of tanks containing the required processing solutions. This method has satisfied the reliability and efficiency requirements for the traditional photofinishing systems largely due to the fact that the film cartridge is discarded and thus no longer serves any other purpose in subsequent stages of image preparation, storage, and retrieval.

Recent advances in film cartridges, such as described in U.S. Pat. No. 4,834,306, disclose a photographic film cartridge wherein the filmstrip may be thrust out of the cartridge and retracted back into the cartridge a number of times (hereinafter referred to as thrust film cartridge). For example, the thrust film cartridge can be used as a primary storage for the processed film, and can be used with related film handling equipment which can be configured to accept the thrust-type film cartridge. The ability to execute other tasks involved in the preparation, storage, and retrieval of images from a specific filmstrip cartridge is advantageous to the photographer and to the photofinisher. In particular, the method of identifying, sorting, and preferentially reproducing (e.g., selecting desired print parameters; such as frame number, size, quantity, setup, and balancing data), images may be significantly enhanced. It has been proposed that the thrusting filmstrip be detached from the thrust film cartridge prior to chemical processing and processed in the traditional photofinishing equipment and then reattached to the original film cartridge (or similar cartridge) for storage.

The detached method exhibits a number of inherent disadvantages. Specifically, the correct filmstrip and cartridge must be reunited; detaching and reattaching the filmstrip can result in damage to the leader and/or trailing edge of the film which then must be cut and reshaped which adds cost to the process; reattaching of the film can be difficult and require certain standardized equipment. Additionally, the detached system cannot take advantage of the fact that only partial portions of the film may be exposed and developed without exposing the remaining portion of the film in the cartridge.

U.S. Pat. No. 5,093,686 discloses the processing of photosensitive material while the filmstrip is still connected to the film cartridge. This is accomplished by thrusting the film out of the cartridge and dipping the filmstrip into successive tanks, typically referred to as the dip and dunk process. The device includes a vertical transport mechanism for lifting the film up to a horizontal transport position where the film can then be moved horizontally while the film is still extended from the cartridge. This type of process results in the images at the bottom end of the strip to experience more development time than the portions above. Additionally, further expensive equipment is required to move and transport the film through the system.

One solution to the foregoing problem is disclosed in U.S. Ser. No. 08/330,271, filed Oct. 27, 1994, now U.S. Pat. No. 5,543,882, by Daniel M. Pagano, Richard B. Wheeler, and Kevin J. Klees, entitled "Method and Apparatus for Processing Photosensitive Film", which is hereby incorporated by reference. In this application there is provided a plurality of individual processing tanks through which film is spirally mounted in a reel and is successively passed. The film placed in a reel is positioned within each of the tanks. After the reel is positioned within a tank, a propeller is activated which causes processing fluid to be driven past the film. The reel is automatically passed from tank to tank.

Since the cartridge is attached to the filmstrip during processing, the spiral reel must be positioned within the tank so that the cartridge does not get immersed. As a consequence, this requires a specific orientation of the spiral reel with respect to the tanks. As a result, bubbles are sometimes trapped on the emulsion side of the film as the spiral reel is being initially placed within the tank. Once the spiral reel is placed entirely into the tank, the agitation motor is then activated, causing processing solution to move past the film. However, it has been found that if the air bubbles are left on the film for even a brief period of time, for example, about 3–5 seconds, this results in underdeveloped spots being formed on the filmstrip which results in poor quality prints. Thus, it is important to minimize the maintainment of these trapped air bubbles, even for a relatively short period of time on the film.

The present invention provides a method for the foregoing problem.

SUMMARY OF THE INVENTION

In one aspect of the present invention there is provided a method of processing photosensitive material disposed in the spiral reel. The spiral reel containing the photosensitive material is placed into a processing tank which includes an agitation propeller and motor for driving the agitation propeller. The method comprises the steps of:

placing the spiral reel into the tank while simultaneously activating the agitation propeller so as to cause processing solution to move past the photosensitive material as it is being placed within the processing tank so as to minimize and/or prevent trapping of air bubbles on the emulsion side of the film.

In accordance with another aspect of the present invention there is provided a processing apparatus for processing a filmstrip contained in a reel. The apparatus comprises at least one processing tank containing a processing solution therein. A holding mechanism is provided for holding and retaining the processing reel and for positioning the processing reel within the at least one processing tank so that the filmstrip can be submerged within the processing solution contained in the at least one processing tank. An agitation mechanism is provided and comprises a motor and a propeller connected to the motor. The propeller is disposed within the tank for agitating the processed solution contained in the tank. The motor 60 is activated at the appropriate time by conventional control means, for example, a CPU (a computer which has been pre-programmed) and which is appropriately connected to the motor control (not shown) as is conventionally known in the art. Before the reel 50 is lowered into the processing solution, the motor 60 is activated causing the processing solution to be moved past the filmstrip as it is being placed within the processing solution.

These and other advantages of the present invention will become more clearly understood and appreciated from our review of the following detailed description and dependent claims, by reference to the accompanying drawings.

DETAILED DESCRIPTION OF THE INVENTION

Figure 1:
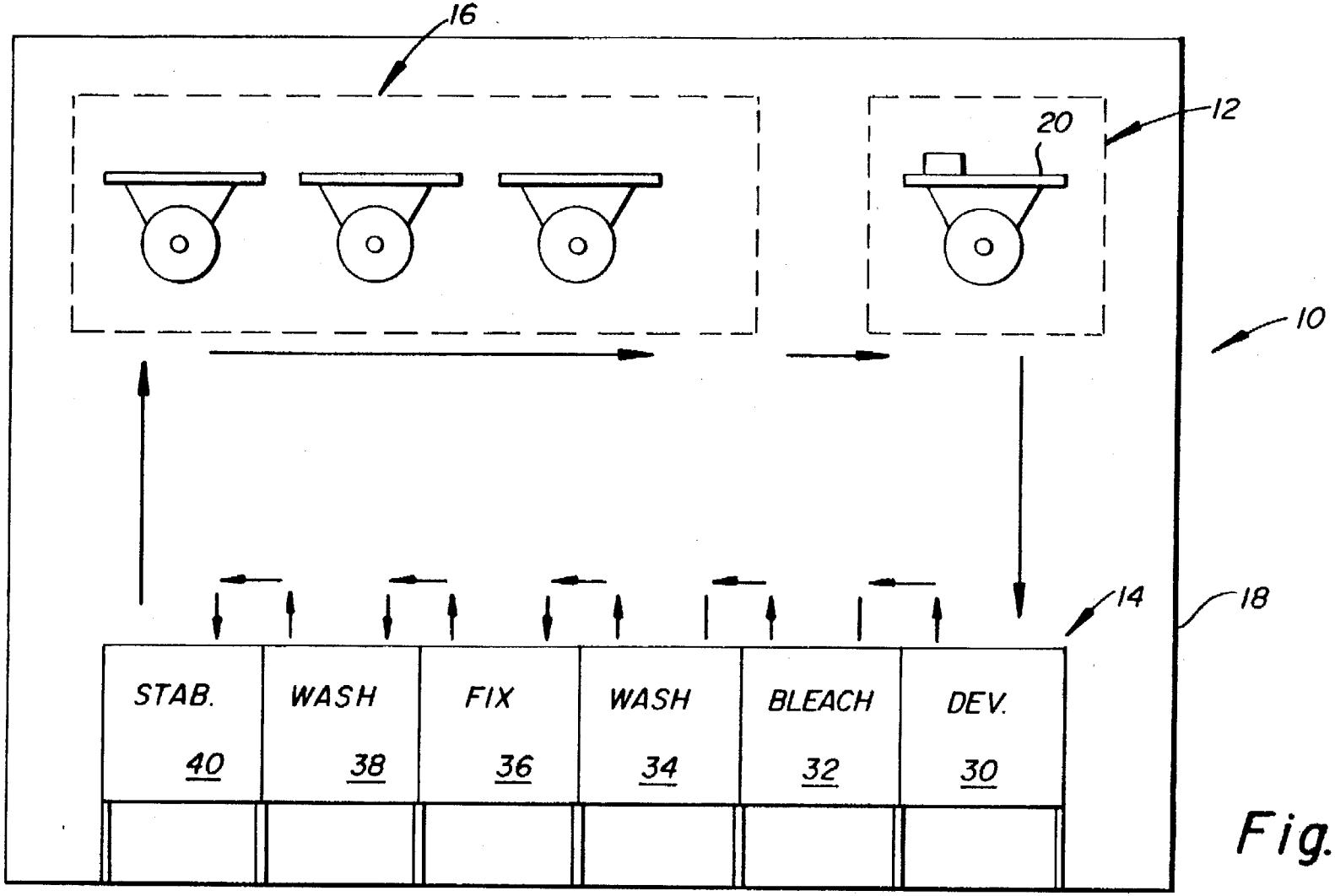
FIG. 1 is a diagrammatic representation of an apparatus utilizing the method according to the present invention.
Figure 2:
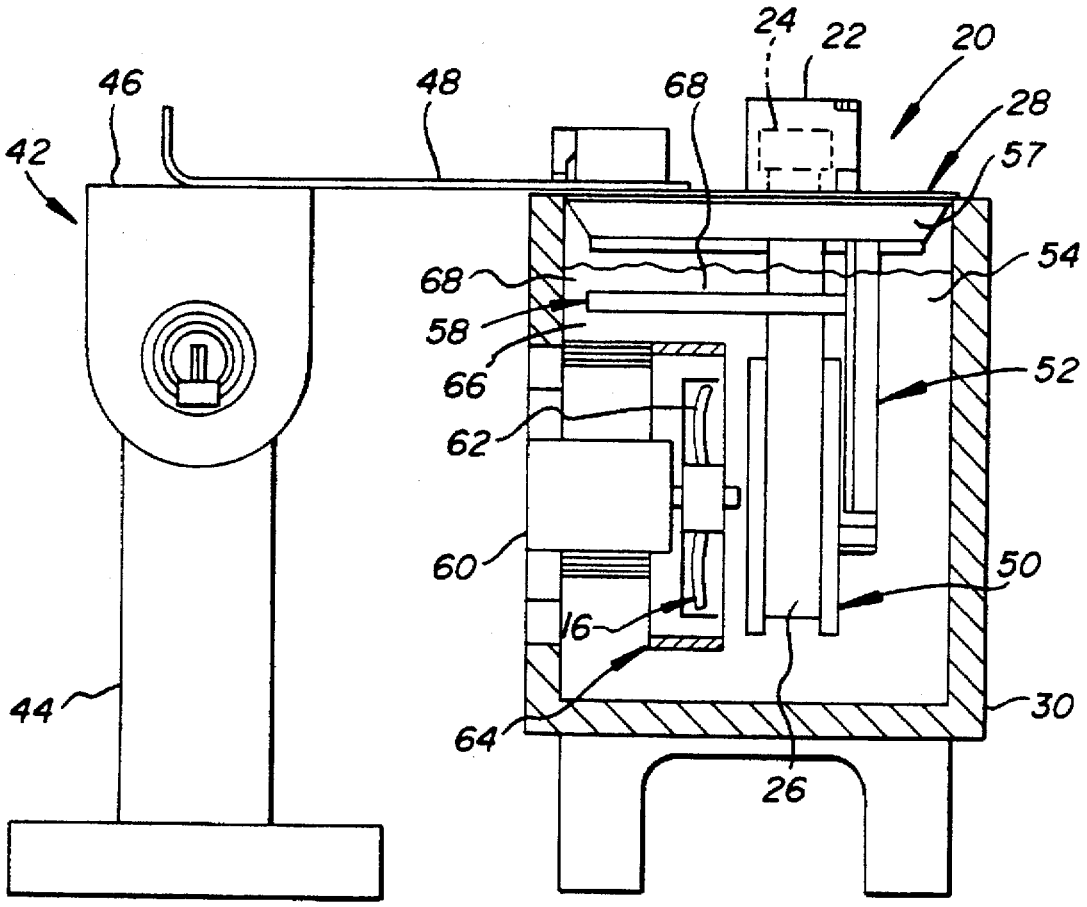
FIG. 2 is a partial sectional view of the processing section of the apparatus of FIG. 1 illustrating a processing tank, processing fluid, and propeller, and a film holding reel and tank cover in the operating position.

Referring to FIGS. 1 and 2, there is illustrated in schematic form a processing apparatus 10 made in accordance with the present invention. The apparatus 10 is designed to process photosensitive material, such as photographic film. In the particular embodiment illustrated, the apparatus is particularly adapted for processing photosensitive film that has been provided in a film thrust-type cartridge such as disclosed in U.S. Pat. No. 4,834,306, commonly assigned to the assignee of the present application, and which is hereby incorporated by reference. The apparatus 10 includes a load/unload station 12, a film processing section 14, and a drying section 16. As is typical with such processing apparatus, a housing 18 is provided for containing the load/unload station, film processing section and drying section, and for providing a light-tight environment within the housing 18. Housing 18 is appropriately sized and configured so as to fully enclose the components and allow access as required. A detailed description of the apparatus 10 and its operation is described in U.S. Ser. No. 08/330,271, filed Oct. 27, 1994, now U.S. Pat. No. 5,543,882, by Daniel M. Pagano, Richard B. Wheeler, and Kevin J. Klees, entitled "Method and Apparatus for Processing Photosensitive Film", previously referenced to herein. The apparatus 10 is designed such that it is possible to process film while the filmstrip is still attached to a film cartridge.

In the embodiment illustrated, six processing tanks are provided. In particular, there is provided a development tank 30 which contains a photographic developer solution, a bleach tank 32 containing a photographic bleach solution, a first wash tank 34 containing a wash solution, a fix tank 36 containing a fixing solution, a second wash tank 38 containing a wash solution, and a stabilizer tank 40 containing a stabilizing solution. It is, of course, understood that any desired number of processing tanks may be provided, each containing the desired processing solution.

Referring to FIG. 2, there is illustrated a holding mechanism 20 having a nest 22 for holding a film cartridge 24. The cartridge 24 is of the thrust-type and contains a filmstrip 26. That is, a film cartridge capable of thrusting out the filmstrip or rewinding the filmstrip back into the cartridge by rotating the cartridge spool which is secured to the end of the filmstrip such as described in U.S. Pat. No. 4,834,306. The holding mechanism further includes a cover 28 designed to mate with each of the processing tanks.

Figure 3:
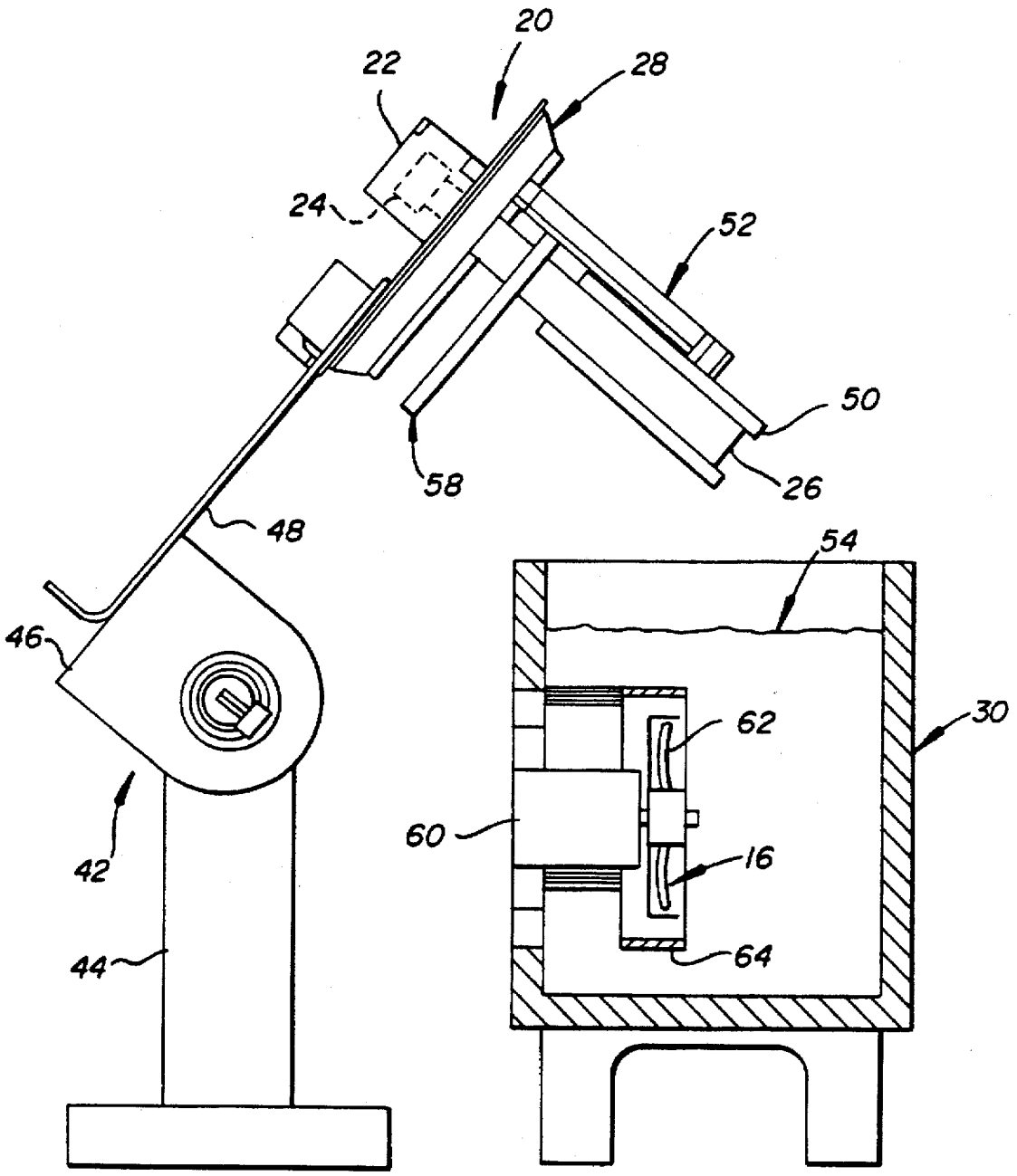
FIG. 3 is a view similar to FIG. 2 showing the film holding reel and tank cover in the out of tank position.

A transport mechanism 42 is provided for automatically transporting the holding mechanism 20 through each of the processing tanks 30,32,34,36,38,40. The transport mechanism includes a base 44 secured to apparatus 10, a mounting block 46 which is rotatably mounted to base 44, and a lift member 48 having one end secured to mounting block 46 and the other end secured to holding mechanism 20. The mounting block 46 is mounted to base 44 such that the holding mechanism 20 may be rotated between an operative position (as shown in FIG. 2) and the transport position (as illustrated in FIG. 3). The mounting block 46 is also capable of being moved in a direction such that the holding mechanism 20 will be moved to a position adjacent to each of the processing tanks 30,32,34,36,38,40. Further details of the transport mechanism 42 and holding mechanism 20 are set forth in the previously referred to Ser. No. 08/330,271 of Pagano, Klees, and Wheeler.

Figure 4:
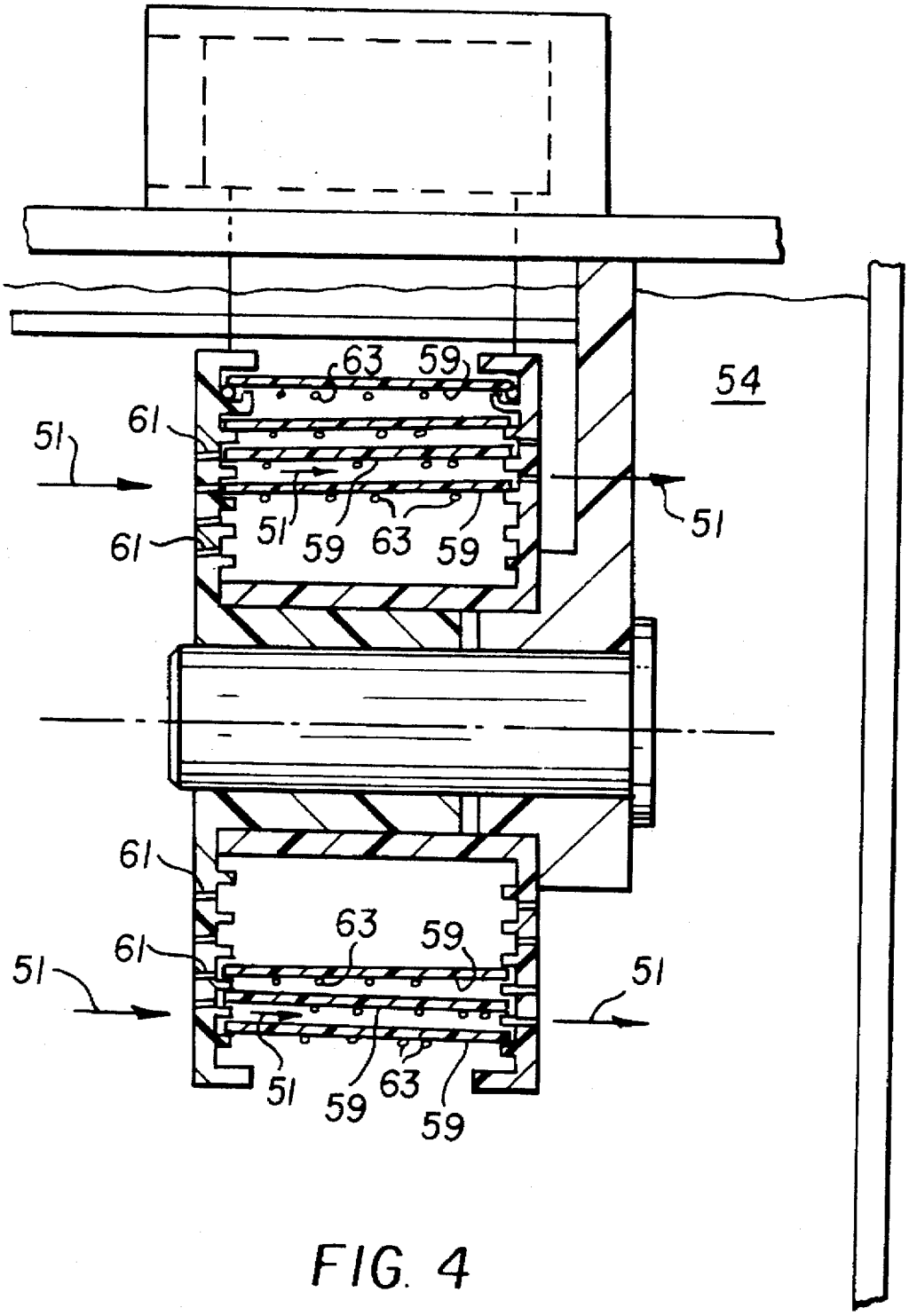
FIG. 4 is an enlarged cross-sectional view of the film holder reel of FIG. 2.

The holding mechanism 20 further includes a reel 50 which is used to hold the portion of filmstrip 26 that has been thrusted out of cartridge 24 for processing. The filmstrip 26 is held in a spiral pattern as illustrated in FIG. 4, such that the processing solution can flow between adjacent convolutions of the filmstrip as indicated by arrows 51 in each of the processing tanks it passes. A support arm 52 connects reel 50 with tank cover 28. Fluid 54 fills tank 30 to a level between the top of reel 50 and the bottom of tank cover 28. Appropriate means (not shown) is provided for thrusting the portion of filmstrip 26 to be processed out of the cartridge 24 and into reel 50 and then back into cartridge 24, such as described in copending application Ser. No. 08/330,271. The trailing end portion of filmstrip 26 is attached to cartridge 24 as it is being processed. A baffle 56 is attached to support arm 52 and placed above reel 50, but below the top level of fluid 54. A slot (not shown) is used to pass film 26 through baffle 56 and onto reel 50.

Means are provided for agitating and passing the processing solution adjacent the surface of the film while in reel 50 in each of the tanks 30,32,34,36,38,40. For the sake of clarity, only the agitation means provided in tank 30 will be discussed, it being understood that similar means may be provided in each of the other tanks. In particular, there is provided a motor 60 having a propeller 62 for providing agitation and causing the processing solution 54 to pass through openings 61 (see FIG. 4) in the side walls 53,55 of reel 50 such that the processing solution 54 is continuously allowed to flow past the emulsion placed on the filmstrip 26. The cover 28 mates with the upper end of the tank so as to provide a substantially sealed processing tank such that when the motor 60 is activated, the processing solution will be maintained within the processing tank. A shroud 64 is provided around the periphery of propeller 62 so as to direct the processing solution to reel 50. In the embodiment illustrated, a baffle 58 is provided for minimizing surface turbulence. The motor 60 is activated at appropriate times by conventional control means, for example, a CPU (a computer, not shown, which has been pre-programmed), and which is appropriately connected to the motor control (also not shown) as is conventionally known in the art. The CPU is also used to run and control the general operation of the apparatus 10 as is customarily done in the art.

During normal operation of the apparatus the reel is moved from the position illustrated in FIG. 3 and placed into the developing solution as illustrated in FIGS. 2 and 4. As can be seen, the spiral wrap of the film in reel 50 results in the surface 59 of the film to be positioned in a plane which is substantially parallel to the direction of movement of the processing solution and substantially parallel to the surface 59 of the processing solution 54. Positioning of the reel 50 in this manner allows air bubbles 63 to become trapped as illustrated in FIG. 4. In the prior art operation of the apparatus, the motor 60 is not activated until the reel 50 is fully seated in the immersed position as illustrated in FIG. 2. However, Applicants have found that this results in spots being formed on the emulsion side of the film, which later results in poor quality of the developed film and resulting prints made therefrom. This is avoided by minimizing and/or preventing the maintenance of these trapped air bubbles 63 for any significant period of time on the emulsion side of the film. This is accomplished by turning on the motor 60 at a relatively low rpm, for example, approximately 600 rpm, before the reel 50 containing the film is lowered into the developing tank 30 as illustrated in FIG. 3. As the reel 50 is being immersed into the processing solution 54, the motor is moving the processing solution against the reel 50. When the film reel 50 is fully immersed in the tank and at its seated position, as illustrated in FIGS. 2 and 4, the speed of propeller 62 is increased to its normal rpm (generally about 1250 rpm). This sequence results in driving off trapped air bubbles immediately off the film as it is lowered into the processing tank, thus minimizing or eliminating the presence of trapped air on the emulsion side of the film.

While in the preferred embodiment illustrated the film being processed is still attached to the film cartridge, the present invention is not limited such as is applicable to any film reel containing film being disposed into a processing tank as described above.

Another method of preventing spotting which results in uneven development of the film comprises turning the propeller 62 on high speed before the spiral reel 50 is lowered into the developing tank. Preferably when this type method is implemented, the tank height should be sufficiently high above the level of the processing solution therein so as to prevent fluid from overflowing resulting from the high agitation. This type system is not as useful in situations where the film is still attached to the film cartridge due to the film trailer length, i.e., the maximum distance between the reel and the film cartridge.

It is to be understood that various other changes and modifications may be made without departing from the scope of the present invention, the present invention being limited by the following claims.

Parts List:

10 . . . apparatus
12 . . . load/unload station
14 . . . film processing section
16 . . . drying section
18 . . . housing
20 . . . holding mechanism
22 . . . nest
24 . . . film cartridge
26 . . . filmstrip
28 . . . tank cover
30 . . . development tank
32 . . . bleach tank
34 . . . first wash tank
36 . . . fix tank
38 . . . second wash tank
40 . . . stabilizer tank
42 . . . transport mechanism
44 . . . base
46 . . . mounting block
48 . . . lift member
50 . . . reel
51 . . . arrows
52 . . . support arm
53,55 . . . side walls
54 . . . fluid
58 . . . baffle
59 . . . surface
60 . . . motor
61 . . . openings
62 . . . propeller
63 . . . air bubbles
64 . . . shroud

I claim:

1. A method of processing photosensitive material disposed in the spiral reel wherein said spiral reel containing said photosensitive material is placed into a processing tank which includes an agitation propeller and motor for driving the agitation propeller, the method comprising:

placing the spiral reel into the tank while simultaneously activating said agitation propeller so as to cause processing solution to move past said photosensitive material as it is being placed within said processing solution so as to minimize and/or prevent trapping of air bubbles on the emulsion side of the film.

2. The method according to claim 1 wherein said agitation propeller is operated at a first rpm during placement of said processing reel into said tank and a second higher rpm after said processing reel has been fully positioned within said processing solution.

3. The method according to claim 2 wherein said first rpm is about 600.

4. The method according to claim 2 wherein said second higher rpm is about 1250.

5. A processing apparatus for processing a filmstrip contained in a reel, said apparatus comprising:

at least one processing tank containing a processing solution therein;

a holding mechanism for holding and retaining said processing reel and for positioning said processing reel within said at least one processing tank so that the filmstrip can be submerged within the processing solution contained in said at least one processing tank;

an agitation mechanism comprising a motor and a propeller connected to said motor, said propeller being disposed within said tank for agitating the processed solution contained in said tank; and a control mechanism for causing said processing solution to be moved past said processing reel as it is being placed within said processing solution.

6. An apparatus according to claim 5 further comprising means for operating said propeller at a first speed rpm during placement of said processing reel into said processing solution at a second higher speed after said processing solution has been fully sealed within said processing solution.

7. An apparatus according to claim 5 wherein said control mechanism includes a CPU for activating the motor at the appropriate time and desired speed.

8. An apparatus according to claim 6 wherein said means for operating said propeller comprises a CPU.

* * * * *